United States Patent [19]

Vargas

[11] 4,023,243

[45] May 17, 1977

[54] SELF-CONTAINED COMPONENT FOR USE IN MAKING WATCH BANDS

[75] Inventor: Walter Smith Vargas, North Kingston, R.I.

[73] Assignee: Textron, Inc., Providence, R.I.

[22] Filed: Apr. 28, 1976

[21] Appl. No.: 681,072

[52] U.S. Cl. ..... 24/265 B; 224/4 E

[51] Int. Cl.[2] ..... A44C 5/18

[58] Field of Search .... 24/265 B, 265 WS, 73 WW; 224/4 E, 4 D

[56] References Cited

UNITED STATES PATENTS

| | | | |
|---|---|---|---|
| 2,507,701 | 5/1950 | Feiner et al. | 24/265 B |
| 3,705,456 | 12/1972 | Bruner | 24/265 B |
| 3,897,612 | 8/1975 | Bert | 24/265 B |

*Primary Examiner*—Paul R. Gilliam
*Assistant Examiner*—Kenneth J. Dorner

[57] ABSTRACT

A self-contained component for use in making an end attachment for a watch band adapted to be mounted between spaced lugs of a wrist watch which permits use of a watch band with wrist watches having different spacings between their attachment lugs. The self-contained component may be used in the end attachment portions of a watch band and it includes a generally tubular member formed from a strip of bendable material having two pairs of tabs, one pair adjacent to one end of the strip and the other pair adjacent to the other end thereof. Coiled compression spring means is located within the generally tubular member. The component also includes a pair of generally tubular inserts adapted to slide within the generally tubular member and each insert is formed with a generally rectangular slot which has an open outer end and a substantially closed inner end. The facing ends of each of the pairs of tabs are bent inwardly into the adjacent generally rectangular slot of the associated generally tubular insert to provide sliding engagement between their inner surfaces and the opposite longitudinal edges of the slot during longitudinal movement of the insert relative to the generally tubular member. These tabs are formed to prevent skewing of the insert relative to the generally tubular member. Preferably the inner edges of the tabs engage the inner ends of the rectangular slots and thereby stop excessive outward movements of the inserts by the coiled spring means.

9 Claims, 10 Drawing Figures

SELF-CONTAINED COMPONENT FOR USE IN MAKING WATCH BANDS

BACKGROUND OF THE INVENTION

Watch bands are often sold separately from the watches to which they are to be attached. One reason for this is that styles in watch bands change more rapidly than styles in watches and watch cases and, during the life of the watch, wearers therefore frequently use several different watch bands. Another reason is that the preference of the user for watch bands of different types such as leather, plastic, metal, snake chain, buckle secured, or expansible may change from season to season or at the whim of the person concerned.

One problem presented to the manufacturer of watch bands is that the watch case lugs between which the end attachments of the watch bands are to be secured are not uniformly spaced in all watches. The watch band manufacturer therefore has been forced to make watch bands having a variety of widths of end attachments so as to fit various watch sizes and the jeweler from which the watch band is bought must perform delicate and time consuming operations on the end attachment to make it fit a particular watch. These tasks are expensive for the watch band manufacturer and for the retail dealer.

There have been many proposed solutions of the problem over a long period of time.

Examples of these proposed solutions are shown and described in Bert U.S. Pat. No. 3,897,612 dated Aug. 5, 1975 and in the application for reissue thereof Ser. No. 605,288 filed Aug. 18, 1975, which is to be granted May 4, 1976 as reissue U.S. Pat. No. 28793, and in the patents cited by the Examiner against the applications therefor and by the Applicant in the specifications thereof and the prior use cited by the Applicant in the Amendment Under Rule 312 filed in the application for reissue.

Other United States patents which have been called to my attention are:

| U.S. Pat. No. | Date | Inventor |
|---|---|---|
| 3,939,534 | February 24, 1976 | Hayes |
| 3,824,783 | July 23, 1974 | Nadeau |
| 1,525,424 | February 3, 1925 | King |
| 1,730,920 | October 8, 1929 | Dinstman |
| 1,742,457 | January 7, 1930 | Wittman |
| 2,718,750 | September 27, 1955 | Spalding |
| 2,667,739 | February 2, 1954 | Flaig |
| 2,608,050 | August 26, 1952 | Bender |
| 1,550,024 | August 18, 1925 | Garst |
| 3,750,238 | August 7, 1973 | Tanner |

The closest prior art of which I am aware is Bert, U.S. Pat. No. 3,897,612 which in FIGS. 5 to 7 discloses a self-contained component for use in making end attachments for watch bands which includes a generally tubular member 21 formed from a strip of metal having a tab 24 adjacent to one of its ends and a tab 25 adjacent to its other end. It also includes two coiled compression springs 30 and a pair of hollow generally tubular inserts 32 each of which has a generally rectangular slot 32 having an open outer end and a substantially closed inner end. Each insert is formed from a strip of metal and the closed end of the slot is formed by the edges of a pair of tabs 34 which extend inwardly towards each other. The component can be assembled by an automatic machine which inserts the coiled springs into the generally tubular member 21 and then simultaneously inserts the hollow inserts at opposite ends of the tubular member compressing the springs until the inner ends of the rectangular slots pass beyond the tabs 24 and 25. Then the ends of the tabs 24 and 25 are bent into the longitudinal slots. Then the pressure on the outer ends of the inserts is released, the inner edges of the tabs 24 and 25 engage the outer edges of the tabs 34 and stop further outward movements of the inserts by the coiled springs.

While that prior art component is economical to manufacture and is easily assembled with the ends of metal, leather and plastic watch bands, it has been found that the inserts 32 skew relative to the generally tubular member thereby detracting from the aesthetic appearance of the ends of the watch band when the band is attached to a watch and the combination is worn by the user.

BRIEF SUMMARY OF THE INVENTION

One object of this invention is to provide a self-contained component for use in making a watch band adapted to be mounted between lugs of wrist watch cases which are spaced different distances apart, the component being economical to manufacture and to assemble within the end of a watch band and in which the end elements of the component do not skew relative to the centrally disposed generally tubular member thereof.

A further object is to provide such a self-contained component which can be assembled automatically.

Another object is to provide a new self-contained component for use in making end attachments for watch bands.

Further objects and advantages of the invention will be apparent to persons skilled in the art from the following description taken in conjunction with the accompanying drawings.

In general, the self-contained component of this invention includes a generally tubular member formed from a strip of bendable material, two pairs of tabs, one pair adjacent to one end of said strip and the other adjacent to the other end thereof, coiled compression spring means within the generally tubular member and a pair of generally tubular inserts adapted to slide within the generally tubular member. Each insert is formed with a generally rectangular slot which has an open outer end and a substantially closed inner end. The facing ends of each of the pairs of tabs are bent inwardly into the adjacent generally rectangular slot of the associated generally tubular insert and the tabs provide sliding engagement between their inner surfaces and the opposite longitudinal edges of the slot during longitudinal movement of the insert relative to the generally tubular member and also prevent skewing of the insert relative to the generally tubular member.

In a preferred embodiment, the inner edges of the tabs of the generally tubular members engage the inner ends of the rectangular slots of the inserts thereby to stop excessive outward movements of the inserts by the coiled spring means.

In another preferred embodiment, the generally tubular member of the component is formed from a strip of metal.

In still another preferred embodiment, each insert is formed from a strip of metal and the generally rectangular slot is formed between the edges of the strip of metal.

In a further preferred embodiment, the inner end of the generally rectangular slot is formed by the edges of a pair of tabs which extend inwardly towards each other.

In another preferred embodiment, stop means is provided extending inwardly from the generally tubular member substantially midway between its ends for engaging the coiled compression spring means.

It will be apparent to persons skilled in the art that this invention has satisfied the above described objects.

DETAILED DESCRIPTION OF THE PREFERRED EMBODIMENT

Figure 1:
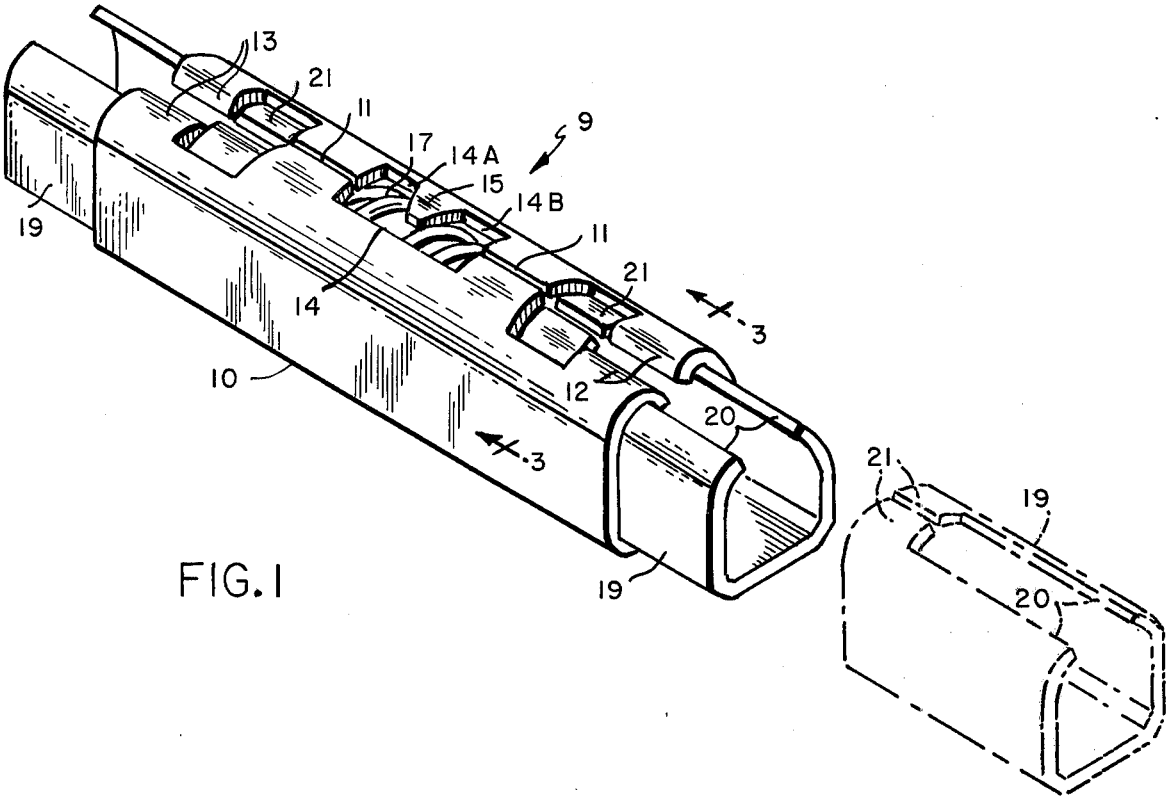
FIG. 1 is an enlarged isometric view looking at the bottom of an assembled self-contained component embodying this invention.

The self-contained component 9 of this invention comprises a generally tubular member 10 formed from a strip of bendable material, such as metal, which is formed into a generally tubular form to provide a longitudinal slit 11 between adjacent ends of the strip. Two pairs of tabs 12 and 13 are formed from the strip, one pair adjacent to one end of the strip and the other pair adjacent to the other end.

Oppositely positioned cutout portions 14 are provided substantially intermediate the ends of the generally tubular member 10 and a tab 15 extends inwardly from the side of one of these cutout portions thereby dividing it into a pair of cutout portions 14A and 14B, the function of which will be described below.

In the preferred embodiment, the self-contained component 9 also includes a pair of coiled compression springs 17 which slide loosely within the generally tubular member 10 and the inner ends of which engage the tab 15 which is bent inwardly of the generally tubular member 10 and forms stop means substantially midway between its ends. However, in its broad aspect, the invention contemplates use of a single coiled compression spring without stop means. In another embodiment, a single coiled compression spring may be used together with a tab such as the tab 15, the end of which is bent inwardly between a pair of coils of the spring to act as stop means to prevent longitudinal movement of the spring with respect to the generally tubular member.

The self-contained component 9 also includes a pair of generally tubular inserts 19 adapted to slide within the generally tubular member 10. Each insert is formed from a strip of bendable material such as metal and is provided with a generally rectangular slot 20 formed between the edges of the strip. This slot has an open outer end and a substantially closed inner end formed by the edges of the pair of tabs 21 which extend inwardly towards each other from the adjacent ends of the strip of metal.

Figure 2:
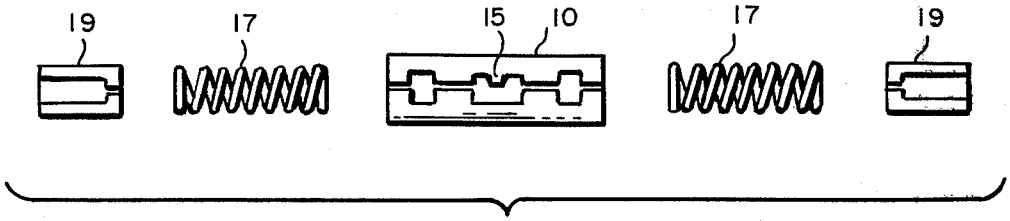
FIG. 2 is an exploded view looking at the bottom of the generally tubular member, pair of coiled compression springs and pair of generally tubular inserts in positions prior to their assembly to form a self-contained component embodying this invention.

In FIG. 2 the parts of the preferred self-contained component are shown in positions ready to be assembled. They can be assembled by an automatic machine which simultaneously inserts the springs 17 at opposite ends of the tubular member 10 until their ends abut the stop means 15, simultaneously inserts the inserts 19 at opposite ends of the generally tubular member 10 and moves them inwardly to compress the springs 17 until the tabs 21 of the rectangular slots 20 pass beyond the tabs 12 and 13 of the generally tubular member 10. Then the ends of these tabs are bent into the longitudinal slots 20. The pressure against the outer ends of the inserts 19 is then released whereupon the springs move the inserts outwardly and the inner edges of the tabs 12 and 13 engage the outer edges of the tabs 21, thereby stopping further outward movements of the inserts by the coiled springs.

Figure 3:
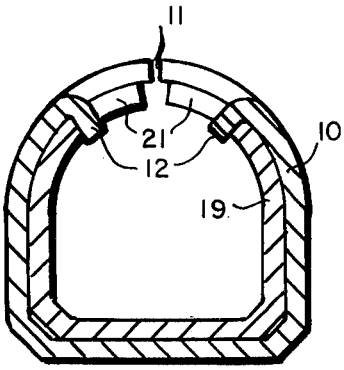
FIG. 3 is a section taken on the line 3—3 of FIG. 1.

It will be observed that the tabs 12 and 13 are bent or rolled in such a manner that their inner surfaces engage the opposite longitudinal edges of the slots 20 as best shown in FIG. 3, and this prevents skewing of the inserts.

The cost of making these self-contained components and of assembling them is extremely small, they are durable and the inserts do not skew relative to the generally tubular member.

Because the outer surfaces of the self-contained components are devoid of any lateral projections they can be easily assembled with end members of metal, leather and plastic watch bands as will appear in further detail below.

THE METAL WATCH BAND EMBODIMENT OF FIGS. 4 TO 8 OF THE DRAWINGS

In these views of the drawings the improved self-contained component is shown installed in an end attachment of a metal watch band.

The numeral 30 designates an expansion watch band secured between the spaced lugs 100 of the wrist watch 101 by the end attachment 33.

Figure 5:
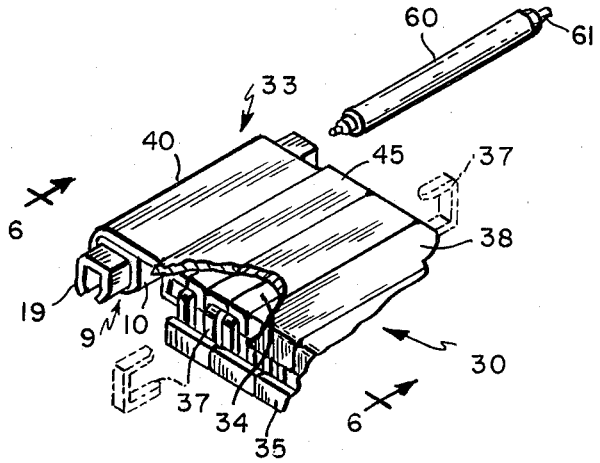
FIG. 5 is an isometric view of a spring bar of a wrist watch and one end of the metal watch band shown in FIG. 4 with parts of the watch band broken away and two of the link connecting means of the watch band shown in dot dash.
Figure 8:
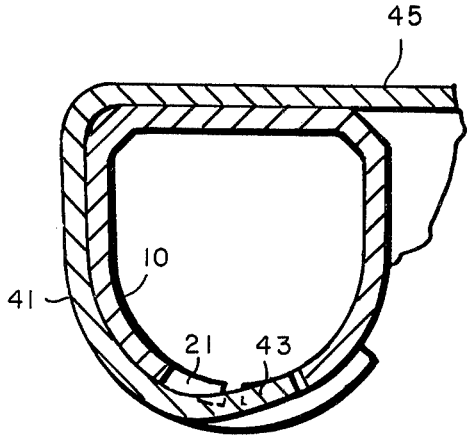
FIG. 8 is a section taken on the line 8—8 of FIG. 7.

While the end attachment is adapted to be used with any conventional metal watch band, it is shown attached to an expansion watch band of the type shown in U.S. Pat. No. 3,307,348 to Vanover although the watch band shown in the present application is wider than the watch band shown in the Vanover patent and uses only one spring in each link. Such a watch band comprises a row of top links 34 (FIGS. 5 and 6) and a row of bottom links 35, each link extending in a direction generally transverse to the length of the linkage. There is a leaf spring 36 located in each link. The links are held together by U-shaped connecting members 37 having their legs positioned between the ends of the springs and the outer walls of the top and bottom links respectively, thus to provide an expansible linkage. The watch band is completed by securing ornamental top shells 38 to the top links. Reference is made to the Vanover patent for further details of construction of this watch band.

Figure 7:
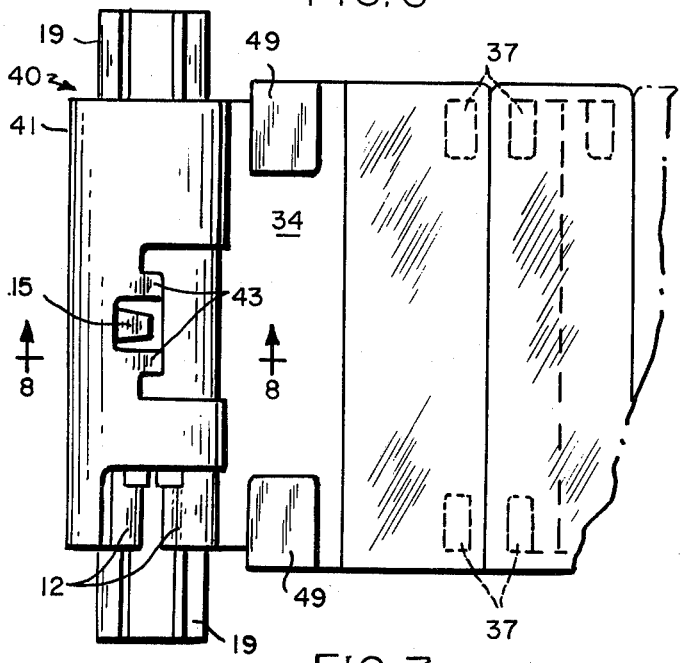
FIG. 7 is an enlarged bottom plan view of one end of the watch band shown in FIG. 4.
Figure 10:
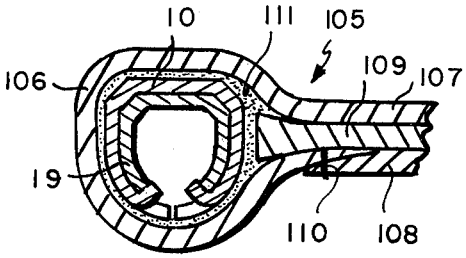
FIG. 10 is a section taken on the line 10—10 of FIG. 9.

The ornamental top shell 40 of the end attachment comprises a generally tubular portion 41 which surrounds at least the upper and end portions and a substantial part of the lower portion of the generally tubular member 10 of the self-contained component 9 and this top shell is provided with a pair of tabs 43 (FIG. 7) which are bent into the openings 14A and 14B (FIG. 1) of the generally tubular member 10 thereby to secure the top shell 40 to the self-contained component 9.

Figure 6:
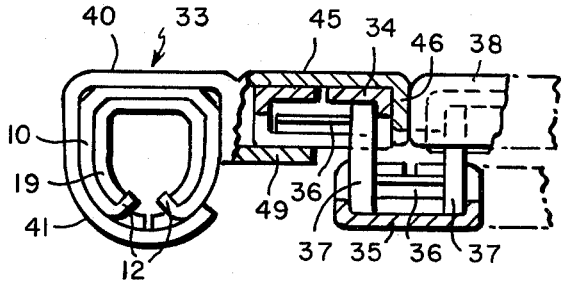
FIG. 6 is an enlarged side elevation looking in the direction of the lines 6—6 of FIG. 5, with parts of the watch band shown in section.
Figure 9:
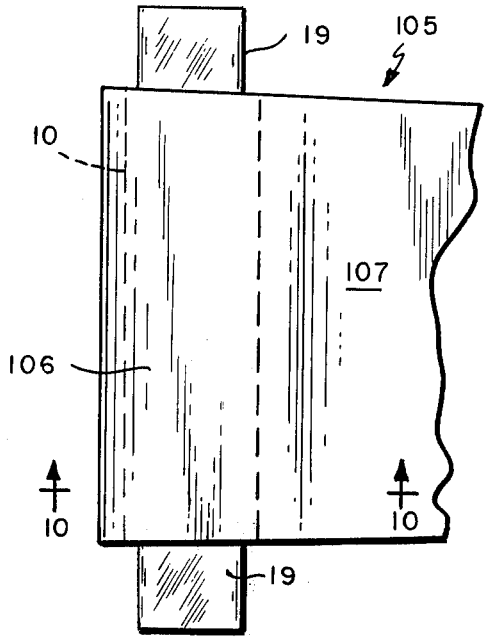
FIG. 9 is a top plan view of one end of a leather watch band containing a self-contained component embodying this invention.

The top shell 40 is provided with a member 45 which extends laterally from the generally tubular portion 41 as shown in FIG. 6. The member 45 is provided with a downwardly extending flange 46 which is positioned between the end top link 34 of the watch band and the top shell 38 of the adjacent link of the watch band. The laterally extending member 45 is also provided with downwardly extending end flanges (not shown) which cover the ends of the end top link 34. These flanges are provided with a pair of inwardly bent tabs 49 (FIGS. 6 and 7) which engage the bottom wall of the end top link 34 of the watch band, thereby cooperating with the flange 46 to secure the top shell 40 to the watch band.

The generally tubular member 10 and the inserts 20 of the self-contained component may be made of stainless steel or other suitable material. The top shell 40 may be made of goldfilled material, stainless steel or other suitable material.

It will be observed that the top shells 40 may be impressed with the design of the top links of the watch band so that the design of the watch band is continuous from end to end thereof including the end connectors. Because the inner surface of the generally tubular portion 41 of the top shell 40 is in contact with the outer surface of the generally tubular member 10 of the self-contained component a deeply impressed design which carries through the metal of the top shell may be impressed on the top shell without interfering with the free sliding movement of the inserts 19 which are only in contact with the inner surface of the generally tubular member 10.

Figure 4:
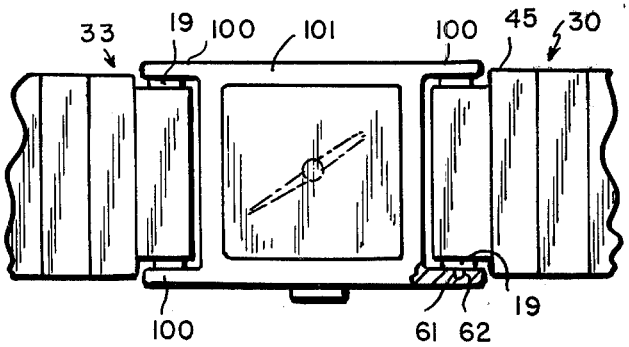
FIG. 4 is a top plan view showing two ends of a metal watch band with its end connectors in place between the lugs of a wrist watch.

In use the spring pin 60 of the watch is inserted through the inserts 19 and coiled springs 17 and one of the pins 61 of the spring pin is inserted in one of the cavities 62 of a watch lug, then the inserts 19 are slid inwardly of the tubular member 10 further compressing the springs and then the other pin 61 is inserted in the cavity of the other watch lug and released, thereby securing the spring pin between the lugs. The springs 17 urge the inserts outwardly so they abut the inner sides of the lugs and the end attachment is secured in place as shown in FIG. 4. They also centralize the end attachment between the lugs 100 of the watch. When a single coiled spring is used instead of two springs and the tab 15 is bent inwardly between two coils of the spring and the end attachment is also centralized between the lugs of the watch by the tab and spring.

To remove the end connector, it is merely necessary to reverse the above steps.

End attachments embodying this invention may be used with snake chain and buckle secured watch bands and watch bands made of components of the type shown and described in U.S. Pat. No. 3,844,136 dated Oct. 29, 1974. They may also be used with other types of metal expansion watch bands such as lazy tongs or X-type watch bands and others which are well known to persons skilled in the art.

THE WATCH BAND EMBODIMENT OF FIGS. 9 AND 10 OF THE DRAWINGS

In these views of the drawings, the new self-contained component is shown as installed in the ends of a leather watch band.

The watch band 105 is made of leather. It is made in two parts, one part having a buckle (not shown) attached to one of its ends and one of the ends of the other part is provided with a series of longitudinally spaced holes (not shown) which can be selectively engaged with the tongue of the buckle as is well known in the art.

Each outer end of the watch band 105 comprises a strip of leather which is folded upon itself to provide a generally cylindrical loop 106, an outer ply 107 and an inner ply 108. A strip of filler 109, which may be made of leather or plastic, is secured between the two plies of leather by a cement which can be heat activated. The ends of the leather strip are secured together by a line of stitches 110 to form the loop.

A self-contained component embodying this invention is incorporated in each end loop 106. Its generally tubular member 10 extends substantially from end to end of the loop and the ends of its inserts 19 extend outwardly beyond the ends of the loop.

The diameter of the loop is large enough so that the self-contained component can be slid longitudinally into the loop.

A layer of cement 111 is applied to the inner surface of the leather strip which forms the loop when cement is applied to the surface of the strip which contacts the filler. After the self-contained component is inserted in the loop, the cement is heat activated and the assembly is cooled to complete the watch band.

The watch band may be made of a strip of plastic or other suitable material instead of leather.

A watch band of this embodiment may be installed between and removed from the lugs, a wrist watch in the same manner as described above with respect to the embodiment of FIGS. 4 to 8 of the drawings.

It will be apparent to persons skilled in the art that a self-contained component embodying this invention has satisfied the above described objects.

While one desirable embodiment of the invention has been shown in the drawings, it is to be understood that this disclosure is for the purpose of illustration only and various changes in shape, proportion and arrangement of parts as well as the substitution of equivalent elements for those shown and described herein may be made without departing from the spirit and scope of the invention as set forth in the appended claims.

I claim:

1. A self-contained component for making an end attachment for a watch band adapted to be mounted between spaced lugs of a wrist watch, comprising a generally tubular member formed from a strip of bendable material and devoid of any lateral projections, two pairs of tabs, one pair adjacent to one end of said strip and the other adjacent to the other end thereof, coiled compression spring means within said tubular member, a pair of generally tubular inserts adapted to slide within said generally tubular member, each insert being formed with a generally rectangular slot which has an open outer end and a substantially closed inner end, and the ends of each of said pairs of tabs being bent inwardly about the opposite longitudinal edges of said generally rectangular slot of the associated generally tubular insert thereby to provide sliding engagement between their inner surfaces and the opposite longitudinal edges of said slot during longitudinal movement of the insert relative to the generally tubular member and to prevent skewing of the insert relative to the axis of the generally tubular member.

2. A component according to claim 1 wherein the inner edges of said tabs of the generally tubular member are positioned to engage the inner ends of the rectangular slot thereby to stop excessive outward movements of said inserts by said coiled spring means.

3. A component according to claim 1 wherein the generally tubular member is formed from a strip of metal.

4. A component according to claim 1 wherein each insert is formed from a strip of metal and said generally rectangular slot is formed between the edges of said strip of metal.

5. A component according to claim 4 wherein the inner end of said generally rectangular slot is formed by the edges of a pair of tabs which extend inwardly towards each other.

6. A component according to claim 1 which also comprises stop means extending inwardly from said generally tubular member substantially midway between the ends of said generally tubular member for engaging said coiled compression spring means.

7. A component according to claim 6 wherein said coiled compression spring means comprises a pair of coiled compression springs, one extending outwardly from one side of said stop means and the other extending outwardly from the other side thereof.

8. A component according to claim 6 wherein said stop means comprises a tab extending inwardly from one end of said generally tubular member substantially midway between the ends of said generally tubular member.

9. A component according to claim 6 wherein the ends of said strip of bendable material from which said generally tubular member is formed comprise oppositely positioned cutout portions substantially midway between the ends of said cutout portions and said stop means comprises a tab extending from one side of one of said cutout portions.

* * * * *